United States Patent [19]

Weeger et al.

[11] Patent Number: 4,996,926

[45] Date of Patent: Mar. 5, 1991

[54] DEVICE FOR GUIDING A TRAVELING SERVICE UNIT ALONG A SPINNING MACHINE OR THE LIKE

[75] Inventors: Hans-Peter Weeger, Hattenhofen; Herbert Grässle, Gmuend-Metlangen, both of Fed. Rep. of Germany

[73] Assignee: Zinser Textilmaschinen GmbH, Fed. Rep. of Germany

[21] Appl. No.: 344,417

[22] Filed: Apr. 25, 1989

Related U.S. Application Data

[63] Continuation of Ser. No. 104,349, Oct. 2, 1987, abandoned.

[30] Foreign Application Priority Data

Oct. 9, 1986 [DE] Fed. Rep. of Germany ..... 3634474

[51] Int. Cl.[5] ..... D01H 09/10

[52] U.S. Cl. ..... 104/243; 57/268

[58] Field of Search ..... 57/268, 264, 263, 261; 104/243, 245, 295, 304

[56] References Cited

U.S. PATENT DOCUMENTS

| | | | |
|---|---|---|---|
| Re. 30,702 | 8/1981 | Keller et al. | 57/268 |
| 867,765 | 10/1907 | Strickler | 104/246 |
| 1,310,664 | 7/1919 | Klassen | 280/776 X |
| 2,985,479 | 3/1961 | Ortega et al. | 104/243 X |
| 3,164,946 | 1/1965 | Du Buis et al. | 57/268 |
| 3,286,857 | 11/1966 | King, Jr. et al. | 57/268 |
| 3,393,762 | 7/1968 | Matson | 104/243 X |
| 3,411,281 | 11/1968 | Guido et al. | 57/261 |
| 3,546,870 | 12/1970 | Schewe et al. | 57/268 |
| 3,672,143 | 6/1972 | Whitney | 57/268 |
| 3,902,308 | 9/1975 | Bernstein et al. | 57/268 |
| 4,219,093 | 8/1980 | Lang | 180/131 |
| 4,653,262 | 3/1987 | Engeli | 57/261 X |
| 4,655,258 | 4/1987 | Breyer | 901/1 X |

FOREIGN PATENT DOCUMENTS

| | | | |
|---|---|---|---|
| 24515 | 9/1959 | Fed. Rep. of Germany . | |
| 434052 | 10/1967 | Fed. Rep. of Germany . | |
| 1803802 | 12/1969 | Fed. Rep. of Germany | 104/245 |
| 3141188 | 7/1986 | Fed. Rep. of Germany . | |
| 1229885 | 6/1987 | Fed. Rep. of Germany . | |
| 102715 | 8/1979 | Japan | 180/131 |
| 384022 | 1/1965 | Switzerland | 104/242 |
| 11717 | 5/1910 | United Kingdom | 104/246 |

*Primary Examiner*—Joseph F. Peters, Jr.
*Assistant Examiner*—Virna Lissi Mojica
*Attorney, Agent, or Firm*—Shefte, Pinckney & Sawyer

[57] ABSTRACT

A guiding device for a traveling service unit for a spinning machine having guide rollers supporting the service unit on the floor and related to a rail engaging member to maintain the service unit at a predetermined spacing from a guide rail running along the machine. In one form of the invention, the guide rollers are pivotally mounted and are pivoted by a connecting rod of the rail engaging member to direct the guide rollers toward or away from the rail upon any deviation of the travel of the service unit so that the service unit will be guided at a proper spacing from the rail and, therefore, from the components of the spinning machine. The control rod can be maintained in proper relation to the rail by followers on the rod straddling the rail or by a spring mounted on the servicing unit and biasing a follower roller on the rod against the rail. As an alternative form, the guide rolls are skewed slightly from the longitudinal direction of the service unit to bias the service unit in the direction of the rail, maintaining a follower roller on the service unit in contact with the rail to properly position the service unit with respect to the spinning machine. The skewing can be fixed or can be spring biased. In the form of the invention where the guide rollers are movable, the control rod can be independently shifted laterally to pivot the guide rollers for selective steering of the service unit away from and independently of the rail.

19 Claims, 2 Drawing Sheets

DEVICE FOR GUIDING A TRAVELING SERVICE UNIT ALONG A SPINNING MACHINE OR THE LIKE

This application is a continuation of co-pending application Ser. No. 104,349 filed Oct. 2, 1987, now abandoned.

BACKGROUND OF THE INVENTION

The present invention relates to a device for guiding a traveling service unit along a spinning machine or the like for proper servicing operation at the work stations of the machine as the service unit travels therealong. More particularly, the present invention is directed to such a device wherein the service unit is supported on the floor by a guide roller that is maintained a predetermined distance from the rail.

Traveling service units are used with spinning machines and other similar machines to perform particular functions at work stations along the machine as is well known. To perform these functions it is necessary that the service unit be maintained at a predetermined transverse spacing from the machine with only slight deviation allowable so that the unit can function properly to engage the components at each work station. It is known to mount service units on carrier rails with the use of support rollers riding on the rails. However, in such an arrangement the carrier rail is subjected to a considerable portion of the weight of the service unit and the machine frame, therefore, must be reinforced, despite which the machine frame can be subjected to undesirable deformation as the service unit travels therealong. A typical prior art device is disclosed in West German patent document DL-PS No. 24,515 wherein the service unit is used for replacing full bobbins with empty bobbin tubes on spindles of a ring spinning machine. This prior art device is in the form of a manually movable carriage having frame guide pieces, guide rollers and running wheels and guide wheels arranged in a manner that allows lateral deviation that is of little concern because large tolerances are accepted in the operation. In contrast, the present invention is directed to a service unit guiding device that guides a service unit along a spinning machine at a controlled transverse spacing therefrom and without considerable force exerted on the spinning machine.

SUMMARY OF THE INVENTION

Briefly described, the device of the present invention guides a traveling service unit along a spinning machine or the like for proper servicing operation at the work stations of the machine as the service unit travels therealong. The device includes a rail extending along the spinning machine, roller means supporting the service unit on the floor adjacent the machine for travel therealong and including at least one guide roller, and control means for maintaining the guide roller a predetermined distance from the rail to maintain the traveling service unit at a uniform predetermined spacing from the spinning machine. The control means includes a rail engaging member carried on the service unit and related to the roller means to maintain the aforesaid spacing.

The rail engaging member may be in positive engagement with the rail to maintain the rail engaging member against movement in either lateral direction with respect to the rail, such as by using a pair of follower rollers straddling the rail to maintain the rail engaging member at a fixed laterally extending orientation with respect to the rail. Alternatively, the rail engaging member may be movable laterally toward and away from the rail and the control means includes means biasing the rail engaging member into engagement with the rail. Also, means may be provided for moving the rail engaging member laterally independent of the rail for pivoting the guide roller and thereby guiding the service unit independent of the rail.

In one of the preferred embodiments the guide roller is pivotally mounted on the unit for pivoting about a generally vertical axis and the rail engaging member is engageable with the guide roller to pivot the guide roller toward and away from the rail to maintain the unit in following relation to the rail, and the rail engaging member is movable laterally with respect to the unit in rail following relation to pivot the guide roller. Preferably, in this embodiment the rail engaging member engages the guide roller at a forward spacing from the axis of the guide roller for controlling pivoting of the guide roller.

Another guide roller may be spaced laterally or rearwardly of the first-mentioned roller for further support and guiding of the service unit in relation to the rail engaging member. Alternatively, a pair of guide rollers may be provided at a rearward spacing from the first-mentioned roller, and another rail engaging member may be carried on the service unit in relation to the pair of guide rollers to cooperate therewith to maintain the aforesaid lateral spacing.

In another preferred embodiment, the guide roller is skewed toward the rail to bias movement of the service unit toward the rail, which skewing may be provided with a fixed roller or may be incorporated with a pivoted roller that is normally positioned skewed toward the rail, but is pivotable toward and away from the skewed position by relation to the rail engaging member.

Further, a proximity switch may be mounted on the service unit adjacent the rail for activation upon contact with the rail.

Other and further features and advantages of the present invention will be apparent from the accompanying drawings and the following detailed description of the preferred embodiments.

DETAILED DESCRIPTION OF THE PREFERRED EMBODIMENTS

Figure 1:
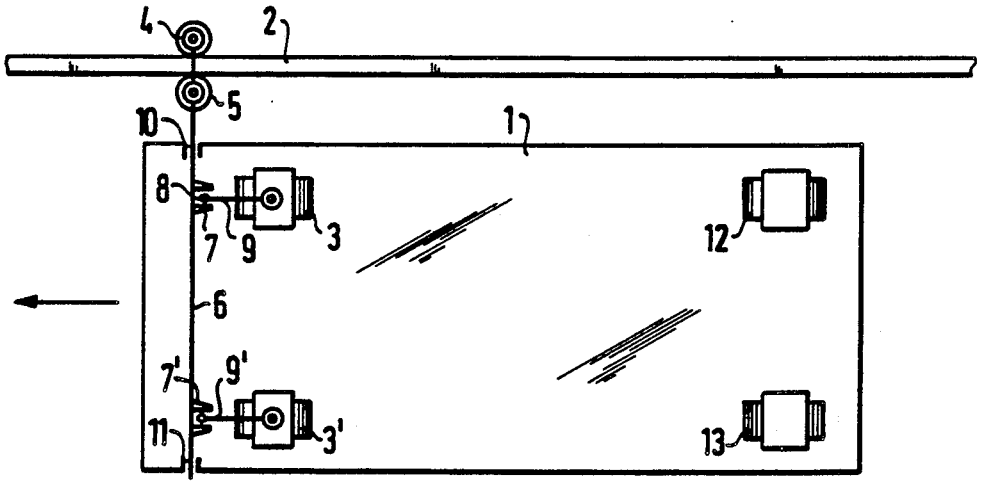
FIG. 1 is a schematic plan view of the control device of a first preferred embodiment of the present invention.
Figure 2:
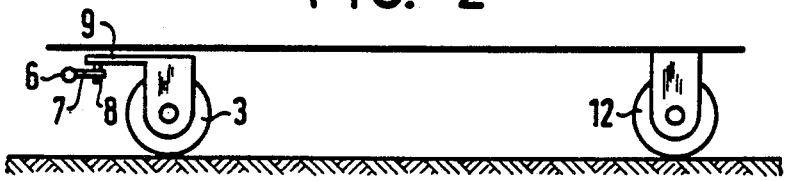
FIG. 2 is a side elevation of the device of FIG. 1.

Referring to FIG. 1, a service unit 1 is illustrated being guided along a spinning machine at a predetermined distance therefrom. The spinning machine and related details as well as the components and operation of the components of the service unit are conventional and are not disclosed or described herein. A rail 2 is mounted on the spinning machine for determining the spacing of the service unit from the machine. This rail 2 is mounted with substantial exactness with respect to the spinning machine so that the service unit 1 can be precisely positioned within close tolerances at the work stations for proper engagement of the components of the spinning machine during performance of the service work.

The service unit 1 is supported on rollers 3 and 3' at the front and rollers 12 and 13 at the rear, which rollers support the unit on a floor adjacent the machine for travel therealong. In the embodiment illustrated there are two rollers 3 and 3' at the front and two rollers 12 and 13 at the rear, but it is also possible to utilize only one roller at the front and one roller at the rear.

The two front rollers are in the form of guide rollers 3 and 3' which include brackets that support the rollers and pivotally connect the rollers to the service unit with guide rods 9 and 9' extending forwardly therefrom for pivoted connection in linkages 7,7' by the use of pins 8 in a rail engaging member in the form of a control the 6 extending laterally across the service unit in front of the rollers 3,3' and mounted in bearings 10,11. This control rod 6 is provided at its end at the guide rail 2 with two follower rollers 4 and 5 that straddle the guide rail 2 for positive following connection therewith. With this articulation, as the service unit 1 is moved along the guide rail 2, any tendency of the service unit to move away or toward the guide rail 2 from a proper spacing will result in the service unit moving laterally with respect to the control rod 6 which will, through the linkages 7,7' manipulate the guide rods 9,9' to pivot the guide rollers 3,3' in a direction to cause the service unit to move back into proper position.

It is possible to have only one of the front rollers used as a guide roller connected to the control rod 6 and use the other roller as a fixed roller. The rollers 12 and 13 at the rear of the service unit may be fixed or may be pivotable and manipulated by a rail engaging member similar to the arrangement at the front of the service unit of FIG. 1.

Figure 3:
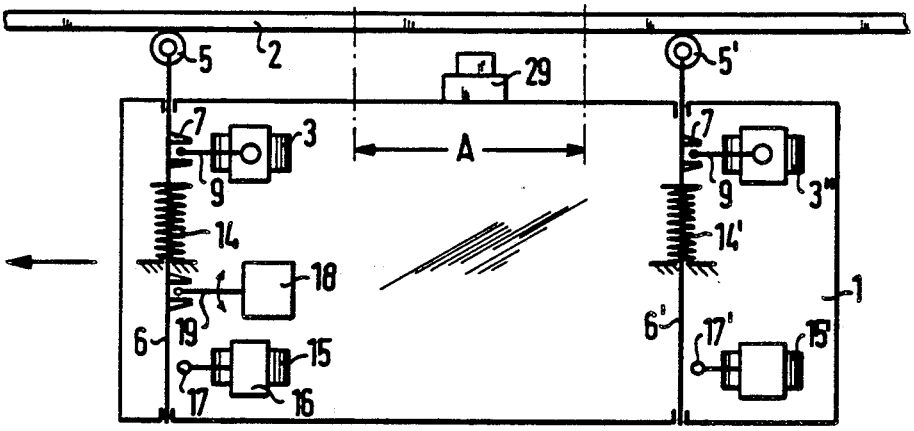
FIG. 3 is a view similar to FIG. 1, illustrating a second preferred embodiment of the device of the present invention.
Figure 4:
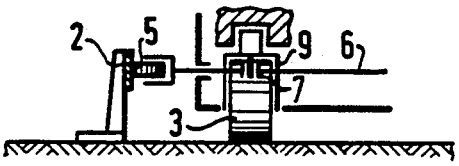
FIG. 4 is a vertical sectional view of a portion of the device of FIG. 3 as viewed facing the components of the device at the upper left of FIG. 3.
Figure 5:
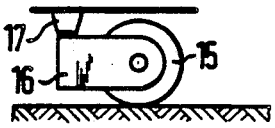
FIG. 5 is a side elevation of a portion of the device of FIG. 3 viewed facing the components at the lower left of FIG. 3.

A second preferred embodiment of the present invention is illustrated in FIGS. 3, 4 and 5, in which the control rod 6 has only one follower roller 5 in engagement with the rail 2. This follower roller 5 is biased in following relation against the rail 2 by a coil spring 14 mounted on the service runner 1 and acting on the control rod 6 in the direction of the rail 2. In this embodiment a guide roller 3 is similarly pivotably controlled by control rod 9 projecting therefrom and connected in a linkage 7 on the control rod 6. This arrangement functions similarly to that of FIG. 1 in that any tendency of the service unit to move laterally during its travel along the rail 2 will be counteracted by a pivoting of the guide roller 3 resulting from the non-lateral movement of the control rod 6 and resulting manipulation of the guide roller 3 through the linkage 7 and guide rod 9.

As seen in FIG. 3, a proximity switch 29 is provided on the side of the service unit 1 facing the guide rail 2 in an area indicated by the arrow A. This proximity switch serves to provide an activating signal for the service unit 1 when it has moved into proper position at a work station.

Another roller 15 is mounted at the front of the service unit 1 at a lateral spacing from the guide roller 3. This second roller 15 does not serve a guiding function, rather it is in the form of a swiveled trailing roller mounted in a bracket 16 that extends forwardly and is swiveled in a bearing 17 about a vertical axis. Similarly, at the rear a swiveled roller 15' is mounted in a bearing 17'.

There is an assembly of components at the rear of the service unit 1 identical to the arrangement described above in regard to the front of the service unit. Thus, a guide roller 3" is pivoted to the service unit 1 and has a guide rod 9 extending forwardly therefrom for connection in a linkage 7 of a control rod 6' that is biased by a coil spring 14 in the direction of the rail 2 at which it carries a follower roller 5'.

In the embodiment of FIGS. 3–5, means are provided for selectively moving the rail engaging member independent of the rail. This is the control member 18, which may be of any powered type of device capable of swinging a guide pin 19 laterally in the direction of the arrow in FIG. 3, which pin 19 is linked to the control rod 6. By this arrangement the service unit can be steered in any direction independent of the rail 2.

Figure 6:
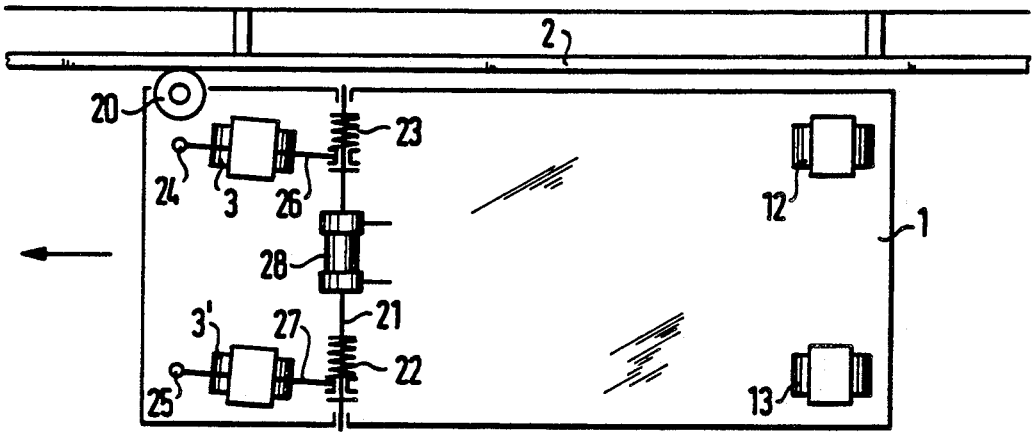
FIG. 6 is a view similar to FIG. 1 illustrating a third preferred embodiment of the device of the present invention.
Figure 7:
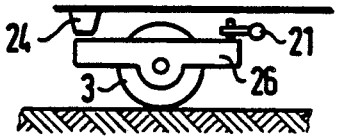
FIG. 7 is a side elevation of the guide roller at the lower left of FIG. 6.

A third preferred embodiment of the present invention is illustrated in FIGS. 6 and 7, in which two guide rollers 3,3' at the front of the service unit are skewed toward the rail 2 to bias the service unit 1 toward the rail 2 to maintain a follower roller 20 at the front of the service unit 1 against the rail 2 as a result of this relationship of the skewed rollers and follower roller. The amount of skewing may be relatively slight as it is only necessary to impose sufficient lateral pressure to maintain the follower roller 20 in engagement with the rail 2. In this regard, only one of the guide rollers need be skewed, and the other could be a swiveled follower roller such as that illustrated and described hereinabove in relation to FIG. 5. Also, rear rollers 12 and 13 may be fixed without pivoting or swiveling on the service unit 1.

The skewing of the guide rollers 3,3' is accomplished by the rollers being pivoted to the service unit 1 at forward pivots 24,25 and having pivot rods 26,27 projecting rearwardly and linked at an offset from the longitudinal direction of the service unit 1 to a transverse control rod 21. This offset is accomplished by the action of springs 22 and 23 mounted on the control rod 21, with the compression of the springs causing greater or lesser skewing in relation to the pressure resulting from the relation between the guide rollers 3,3' and the follower roller 20 being biased against the rail 2. Thus, the contact pressure of the follower roller 20 against the rail 2 corresponds to the force of the springs 22,23.

The device illustrated in FIG. 6 is also capable of selective guiding of the service unit 1 for travel straight ahead or in any direction independent of the rail 2. For this purpose a conventional double-ended hydraulic cylinder 28 is provided with the control rod 21 being positioned as the piston within the cylinder 28 so that the control rod 21 can be shifted laterally to pivot the guide rollers 3,3' to be directed straight ahead or in either lateral direction for steering of the service unit independent of the rail 2.

Figure 8:
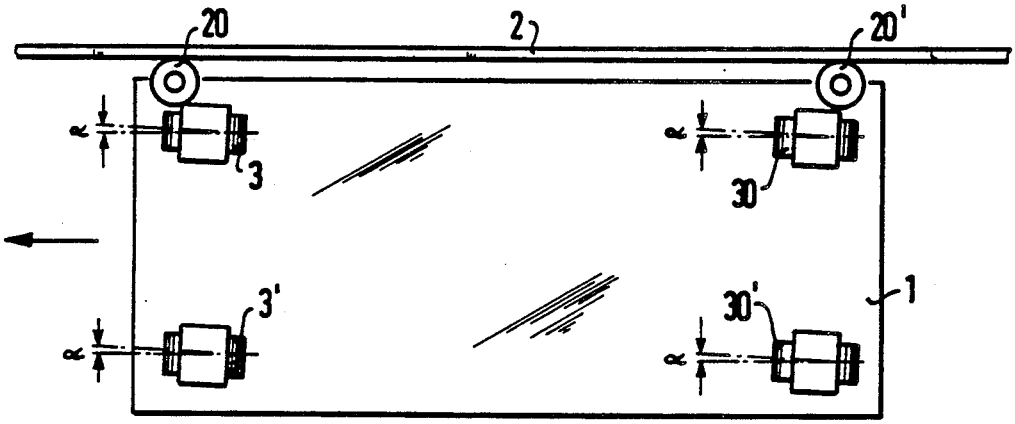
FIG. 8 is a view similar to FIG. 1 illustrating a fourth preferred embodiment of the device of the present invention.

A fourth preferred embodiment of the present invention is illustrated in FIG. 8, in which there are four guide rollers, 3,3', 30 and 30'. Two of these rollers 3,3' are spaced apart at the front of the service unit 1 and the other two rollers 30,30' are spaced apart at the rear of the service unit 1. All four of these guide rollers are fixed to the service unit 1 and they all are skewed at a slight angle indicated by the angle Alpha in the direction of the rail 2. This skewing serves the same function as the skewing described above in regard to the embodiment of FIG. 6 to cause a biasing of follower rollers 20,20' at the front and rear against the rail 2 to maintain the service unit 1 in position at a proper spacing from the rail 2 and spinning machine. The fixed skewing of the guide rollers with respect to the longitudinal axis of the unit is predetermined by selecting an angle Alpha sufficient to maintain pressure of the follower rollers 20,20' against the guide rail 2 while taking into consideration the normal pressure on the guide rollers and the coefficient of friction of the rollers to provide optimum operation otherwise.

In summary, a service unit 1 can be guided by the device in a properly functioning manner along a guide rail of a spinning machine by the relation of a guide roller and a rail engaging member in an arrangement as illustrated and described above. In this regard, the service unit could be any suitable unit for performing desired operations at work stations, e.g., automatically replacing bobbins or automatically threading yarns or any other appropriate functions.

It will therefore be readily understood by those persons skilled in the art that the present invention is susceptible of a broad utility and application. Many embodiments and adaptions of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A traveling service unit for selective servicing of the work stations of a spinning or other textile machine, the textile machine being of the type having a guide rail associated therewith positioned at a uniform spacing from the machine components at the work stations of the textile machine, said traveling service unit comprising:

roller means supporting said traveling service unit on a floor adjacent the textile machine, said roller means including at least one guide roller; and control means for maintaining said guide roller at a predetermined distance from said guide rail to maintain said traveling service unit at a uniform predetermined spacing from the textile machine, said control means including a rail engaging member operatively connected to said guide roller to maintain said uniform predetermined spacing, said rail engaging member is movable laterally toward and away from said rail and said control means includes means biasing said rail engaging member into engagement with said rail; and characterized further by means for moving said rail engaging member laterally independent of said rail for selective pivoting said guide roller and thereby guiding said service unit independent of said rail.

2. A traveling service unit according to claim 1 and characterized further in that said rail engaging member is in positive engagement with said rail to maintain said engaging member against movement in either lateral direction with respect to said rail.

3. A traveling service unit according to claim 2 and characterized further in that said rail engaging member includes a pair of follower rollers straddling said rail and maintaining said rail engaging member at a fixed laterally extending orientation with respect to said rail.

4. A traveling service unit according to claim 1 and characterized further by a pair of guide rollers spaced rearwardly of said first-mentioned guide roller for support of said service unit thereon, and by another rail engaging member carried on said service unit rearwardly of said first-mentioned rail engaging member and related to said pair of guide rollers to maintain said spacing.

5. A traveling service unit according to claim 4 and characterized further in that said guide rollers are pivotally mounted on said unit for pivoting about generally vertical axes, and said rail engaging members are engagable with said guide rollers to pivot said guide rollers toward and away from said rail to maintain said unit in following relation to said rail.

6. A traveling service unit according to claim 1 and characterized further in that said guide roller is pivotally mounted on said unit for pivoting about a generally vertical axis, and said rail engaging member is engagable with said guide roller to pivot said guide roller toward and away from said rail to maintain said unit in following relation to said rail.

7. A traveling service unit according to claim 6 and characterized further in that said rail engaging member is movable laterally with respect to said unit in rail following relation to pivot said guide roller.

8. A traveling service unit according to claim 7 and characterized further in that said rail engaging member engages said guide roller at a forward spacing from the axis of said guide roller.

9. A traveling service unit according to claim 1 and characterized further by another guide roller spaced laterally of said first-mentioned guide roller for support of said service unit thereon.

10. A traveling service unit according to claim 9 and characterized further in that said another guide roller is fixed to said unit without being pivotable with respect thereto.

11. A traveling service unit according to claim 9 and characterized further in that said another guide roller is related to said rail engaging member to maintain said spacing.

12. A traveling service unit according to claim 11 and characterized further in that said guide rollers are pivotally mounted on said unit for pivoting about generally vertical axes, and said rail engaging member is engagable with said guide rollers to pivot said guide rollers toward and away from said rail to maintain said unit in following relation to said rail.

13. A traveling service unit according to claim 12 and characterized further in that rail engaging member is movable laterally with respect to said unit in rail following relation to pivot said guide rollers.

14. A traveling service unit according to claim 1 and characterized further by another guide roller spaced rearwardly of said first-mentioned guide roller for support of said service unit thereon, and by another rail engaging member carried on said service unit rearwardly of said first-mentioned rail engaging member and related to said another guide roller to maintain said spacing.

15. A traveling service unit according to claim 14 and characterized further in that said guide rollers are pivotally mounted on said unit for pivoting about generally vertical axes, and said rail engaging members are engagable with said guide rollers to pivot said guide rollers toward and away from said rail to maintain said unit in following relation to said rail.

16. A traveling service unit according to claim 15 and characterized further in that said rail engaging members are movable laterally with respect to said unit in rail following relation to pivot said guide rollers.

17. A traveling service unit according to claims 10, 14 or 4 and characterized further in that said guide rollers are skewed toward said rail to bias movement of said service unit toward said rail.

18. A traveling service unit according to claim, 6 or 7 and characterized further by a proximity switch mounted on said service unit adjacent said rail and activated by contact with said rail.

19. A traveling service unit according to claim 1 and characterized further in that said guide roller is skewed toward said rail to bias movement of said service unit toward said rail.

* * * * *